US005402092A

United States Patent [19]

Bagalini

[11] Patent Number: 5,402,092

[45] Date of Patent: Mar. 28, 1995

[54] ELECTRO-MAGNETIC DEVICE

[75] Inventor: Dante Bagalini, Johannesburg, South Africa

[73] Assignee: Circuit Breaker Industries Limited, Johannesburg, South Africa

[21] Appl. No.: 120,666

[22] Filed: Sep. 13, 1993

[30] Foreign Application Priority Data

Sep. 14, 1992 [ZA] South Africa ..... 92/7005

[51] Int. Cl.[6] ..... H01F 7/18

[52] U.S. Cl. ..... 335/242; 335/177

[58] Field of Search ..... 335/177, 178, 179, 78–86, 335/151, 152, 153, 154, 242

[56] References Cited

U.S. PATENT DOCUMENTS 1,636,953 7/1927 Dreyer ..... 335/242

2,486,613 11/1949 Ridgley ..... 335/242

2,661,451 12/1953 Tamm ..... 335/242

*Primary Examiner*—Lincoln Donovan

*Attorney, Agent, or Firm*—Ladas & Parry

[57] ABSTRACT

An electro-magnetically operable device 12 for a circuit breaker 10 comprises a coil 13 that defines a cavity. A first plunger 14 and a second plunger 16 are located within the cavity, adjacent one another. The first plunger 14 is housed in a sealed canister 18 which is filled with a damping liquid. The plunger 14 is displaceable within the canister 18 in a damped manner. The second plunger 16 is also displaceable within the cavity and movement thereof is guided by an open tube 20. The first plunger 14 and the second plunger 16 are urged away from a pole piece 30 of the device 12 via helical springs 32 and 34, respectively.

13 Claims, 3 Drawing Sheets

ELECTRO-MAGNETIC DEVICE

FIELD OF THE INVENTION

THIS INVENTION relates to an electromagnetically operable device for a circuit breaker.

SUMMARY OF THE INVENTION

According to the invention, there is provided an electro-magnetically operable device for a circuit breaker, the device including a coil which defines a cavity;

a first plunger arranged in the cavity, the first plunger being displaceable within the cavity in a damped manner between a first, normal position and a second position;

a first urging means for urging the first plunger from its second position towards its first position;

a second plunger arranged in the cavity, adjacent the first plunger, the second plunger being displaceable within the cavity between a first, normal position and a second position;

a second urging means for urging the second plunger from its second position towards its first position; and a magnetic path defining means arranged about at least a part of the coil, the magnetic path defining means including a pole piece, the pole piece and the plungers being arranged such that a gap between the first plunger, when in its normal position, and the pole piece is less than a gap between the second core, when in its normal position, and the pole piece, with the second position of each plunger being closer to the pole piece than the first, normal position of each plunger.

The first plunger may be housed in a sealed canister which contains a liquid to damp movement of the first plunger.

The first and second urging means may be helical springs which are under compression, each spring being arranged intermediate its associated plunger and the pole piece.

The coil may have a round or oval shape.

The magnetic path defining means may include a stator frame arranged about the coil and an armature pivotally arranged relative to the stator frame, the armature being connectable to a tripping mechanism of the circuit breaker.

An air gap may be defined between the stator frame and the pole piece. The second plunger may then be located on that side of the cavity on which the air gap between the pole piece and the stator frame is located.

It will be appreciated by those skilled in the art that the plungers will, in their first positions, be partially located outside the stator frame. The stator frame may thus define two openings, one for the first plunger and one for the second plunger, the plungers projecting through said openings.

The plungers may move towards the pole piece when moving from their first positions to their second positions and may abut against the pole piece when in their second positions.

An end of the second plunger, remote from the pole piece, may carry a link for mechanically linking the second plunger to a moving contact carrier of the circuit breaker, the link being a lost-motion link such that the moving contact carrier can move independently of the second plunger and the second plunger can, to a predetermined extent, move independently of the moving contact carrier. The moving contact carrier is displaceable between an "on" position in which the electrical path of the circuit breaker is closed and an "off" position in which the electrical path is open. The lost-motion link is then such that the second plunger may move from its first position towards its second position without moving the moving contact carrier when the moving contact carrier is in its "on" position; and the moving contact carrier may move from its "on" position towards its "off" position without displacing the second plunger, when the second plunger is in its first position.

When current flows through the coil, magnetic fluxes are set up in each plunger, the values of which are inversely proportional to the gaps between the plungers and the pole piece. The resulting forces, acting on the plungers against their compression springs in the direction of the pole piece, are proportional to the square of the fluxes.

It will accordingly be appreciated that if a first predetermined current, which is relatively low, flows through the coil the force acting on the first plunger, which is larger than that of the second plunger (as the gap between the first plunger and the pole piece is smaller than the gap between the second plunger and the pole piece when there is no current) tends to displace the first plunger towards the pole piece. Movement of the first plunger in its housing is retarded by the liquid in the canister, the degree of retardation or damping being determined by a number of factors, including the viscosity of the liquid. When the first plunger reaches the pole piece, the reluctance of a magnetic circuit formed by the armature, portions of the stator frame and the pole piece and the first plunger is significantly decreased, thereby increasing the electro-magnetic force acting on the pivoted armature which is large enough to displace the armature into contact with the stator frame and the pole piece and thereby trip the circuit breaker.

At medium and high overloads, i.e. with a current significantly larger than the said first current, the force on the first plunger is larger than that on the second plunger, but the closing speed of the first plunger is considerably slower than that of the second plunger due to the effect of the liquid. The force on the second plunger is sufficiently large to compress the spring associated with the second plunger and the second plunger is displaced into contact with the pole piece in a relatively instantaneous manner. Due to the relatively high current, the armature is attracted to the pole piece, thereby tripping the breaker even before the gap of the second plunger is completely closed. When the armature closes, the reluctance of the magnetic circuit passing through the second plunger is reduced causing a drastic increase of the flux therein, resulting in a further acceleration of the second plunger.

Because of the lost-motion linkage between the moving contact carrier and the second plunger, the second plunger is initally accelerated without moving the moving contact carrier. The armature will close almost immediately and, in any event, before the second plunger has moved sufficiently to engage the link. Although the armature will have closed, the tripping mechanism has an inherent delay which will have the result that the moving contact carrier will still be closed even though the armature has closed. However, when the armature closes, the reluctance decreases substantially and the second plunger gets displaced with a greater acceleration. Accordingly, the moving contact carrier is also displaced to its open position extremely rapidly.

The high opening speed of the moving contact during a short circuit introduces a high resistance to the electric circuit limiting the let-through current and the clearing time.

With an appropriate matching of the springs and the initial gaps of the plungers, the following can be achieved:

- accurate trip point and time delay typical of a hydraulic-magnetic circuit breaker;
- positive, accurate and easily pre-settable instantaneous tripping which is independent of the time delay of the damped first plunger;
- effective acceleration of the moving contact carrier on short circuit, which provides proper current limiting; and
- substantial minimization of the possibility of contact welding during overloads.

The invention extends also to a circuit breaker which includes an electro-magnetically operable device as described above.

The coil of the electro-magnetically operable device may, in use, carry the load current of the circuit breaker.

BRIEF DESCRIPTION OF THE DRAWINGS

The invention is now described, by way of an example, with reference to the accompanying drawings, in which.

DETAILED DESCRIPTION OF THE DRAWINGS

Figure 1:
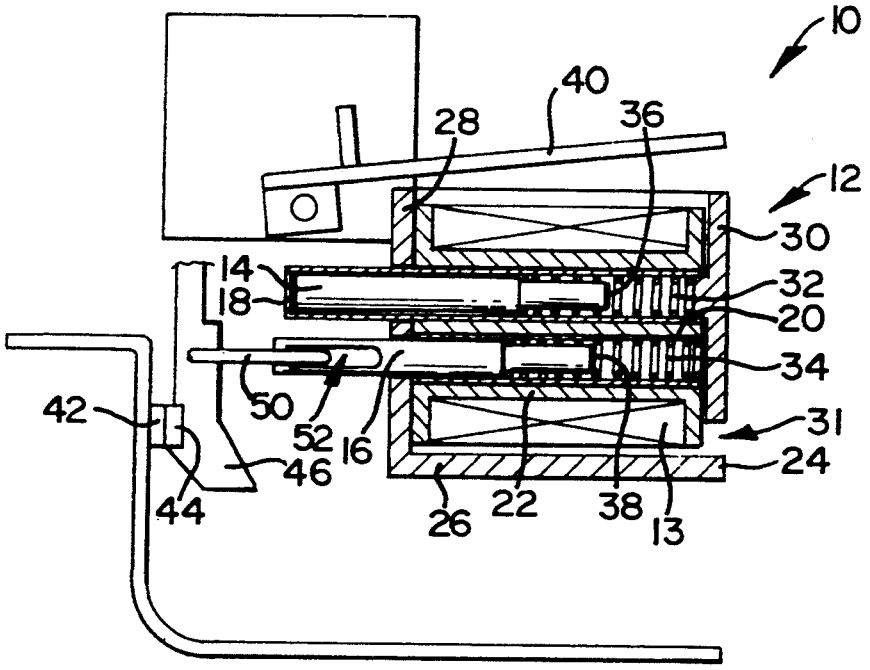
FIG. 1 shows a schematic sectioned view of a portion of a circuit breaker which incorporates an electro-magnetically operable device in accordance with the invention, showing the circuit breaker in its normally operable condition, with its trip mechanism latched and its moving contact carrier closed.

Referring firstly to FIG. 1 of the drawings, a portion of a circuit breaker is designated generally by reference numeral 10. The circuit breaker 10 includes an electro-magnetically operable device 12, in accordance with the invention. The device 12 comprises a coil 13 that defines a cavity. A first plunger 14 and a second plunger 16 are located within the cavity, adjacent one another. The first plunger 14 is housed in a sealed canister 18 which is filled with a damping liquid. The plunger 14 is displaceable within the canister 18 in a damped manner. The second plunger 16 is also displaceable within the cavity and movement thereof is guided by an open tube 20.

The coil 13 is wound on a bobbin 22 which defines the cavity. The coil 13 may be round or oval.

The bobbin 22 is mounted on an "L"-shaped stator frame 24 which has a base 26 and a post 28 extending from the base 26.

As seen in FIG. 1, the canister 18 projects through a first aperture in the post 28 and the second plunger 16 projects through a second aperture in the post 28.

A pole piece 30 is arranged on an opposed side of the bobbin 22 relative to the post 28. The pole piece 30 is separated from the base 26 of the stator frame 24 by an air gap 31. The first plunger 14 is urged away from the pole piece 30 by means of a first helical spring 32 and the second plunger 16 is urged away from the pole piece 30 by a second helical spring 34. The first plunger 14 and the second plunger 16 are stepped, having narrow end portions which are received within the springs 32 and 34, respectively. It will be noted that an end 36 of the first plunger 14 is closer to the pole piece 30 than is an end 38 of the second plunger 16, when the coil 13 is not energised. Thus, the air gap between the first plunger 14 and the pole piece 30 is less than the air gap between the second plunger 16 and the pole piece 30. It will be appreciated by those skilled in the art that, in use, current in the coil 13 will establish flux which will tend to displace the plungers 14 and 16 towards the pole piece 30, against the springs 32 and 34.

The circuit breaker 10 further has an armature 40 which is pivotally displaceable into contact with the free end of the post 28 and the upper end of the pole piece 30. The armature 40 is connected to a tripping mechanism (which is not shown) of the circuit breaker 10 in a known manner.

Further, the circuit breaker 10 has a fixed contact 42 and a moving contact 44. The moving contact 44 is carried by a moving contact carrier 46 which is displaceable between a closed or "on" position in which the contacts 42 and 44 are mechanically and electrically in contact (as shown in FIG. 1) and an open or "off" position in which the contacts 42 and 44 are spaced apart.

The moving contact carrier 46 is mechanically connected to the second plunger 16 by means of a link 50. The link 50 is connected to the second plunger 16 in a lost motion manner, the second plunger 16 having a slot 52 defined therein. The link 50 has a predetermined length and the slot 52 is so arranged that, when the moving contact carrier 46 is in its closed position and there is no current in the coil 13, the end of the link 50 associated with the second plunger 16 is positioned approximately centrally in the slot 52. Thus, if the second plunger 16 is in its unenergised position, the moving contact carrier 46 is free to move from its closed position towards its open position and, when the moving contact carrier 46 is in its closed position, the second plunger 16 can move, a certain extent, towards the pole piece 30 without displacing the contact carrier 46.

It will be noted that the coil 13 carries the load current of the circuit breaker 10.

Figure 2:
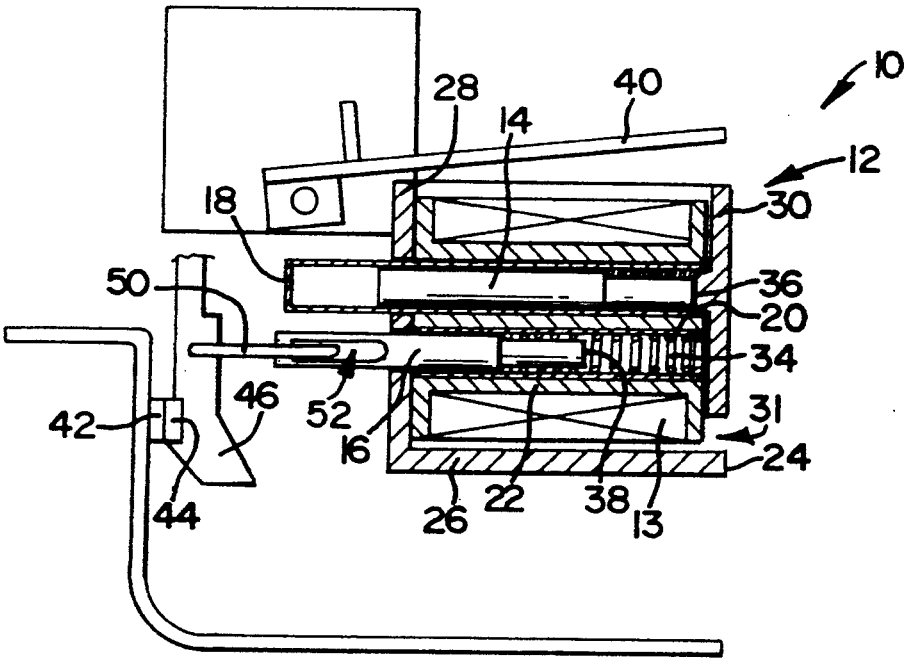
FIG. 2 shows a further schematic sectioned view of the circuit breaker indicating its response to a moderate overload current.
Figure 3:
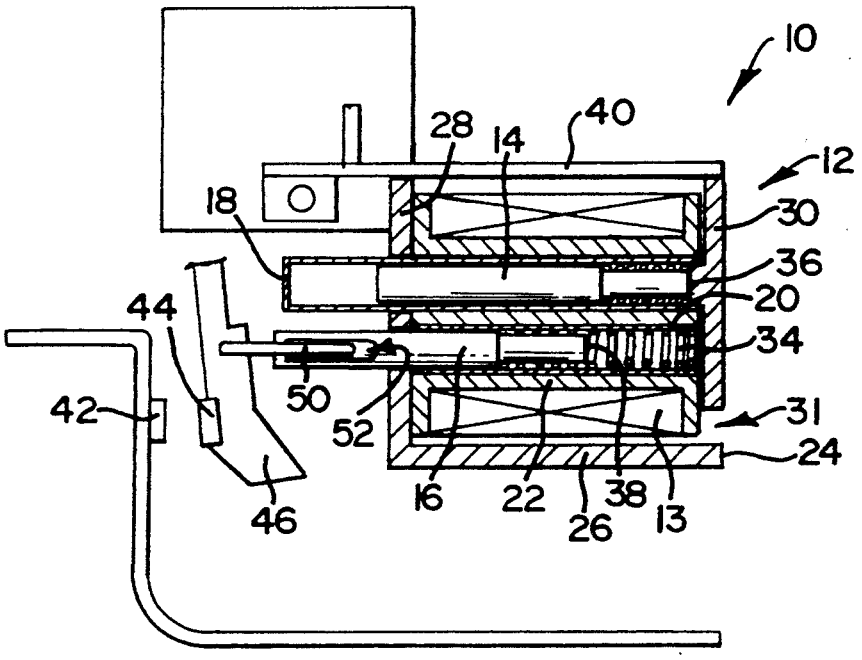
FIG. 3 shows a further schematic sectioned view of the circuit breaker indicating further how it responds to a moderate overload current.

Referring now to FIGS. 2 and 3, the manner in which the circuit breaker 10 responds to a moderate overload current is indicated. Because the initial air gap between the first plunger 14 and the pole piece 30 is smaller than that between the second plunger 16 and the pole piece 30, a moderate overload current will cause the first plunger 14 to be displaced towards the pole piece 30. Because movement of the first plunger 14 is damped by the liquid in the canister 18, it takes the first plunger 14 a predetermined period of time to move into contact with the pole piece 30 (as shown in FIG. 2). This period will depend on a number of factors, including the viscosity of the liquid and the magnitude of the overload current.

When the first plunger 14 abuts against the pole piece 30, the reluctance of a magnetic circuit formed by the armature 40, the post 28, the first plunger 14 and the pole piece 30 is significantly decreased, thereby increasing the electro-magnetic force acting on the armature 40. This force is large enough to displace the armature 40 into contact with the post 28 and the pole piece 30 (as shown in FIG. 3) and thereby operate the tripping mechanism of the circuit breaker 10. The tripping mechanism acts on the carrier 46, displacing it from its closed position to an open position (shown in FIG. 3). Because the current is not sufficient to displace the second plunger 16 to a significant extent, the second plunger 16 remains substantially in its first, normal position. However, because of the lost motion characteristic of the link 50 and the slot 52, the carrier 46 is able to move from its closed position to its open position (as shown in FIG. 3).

Figure 4:
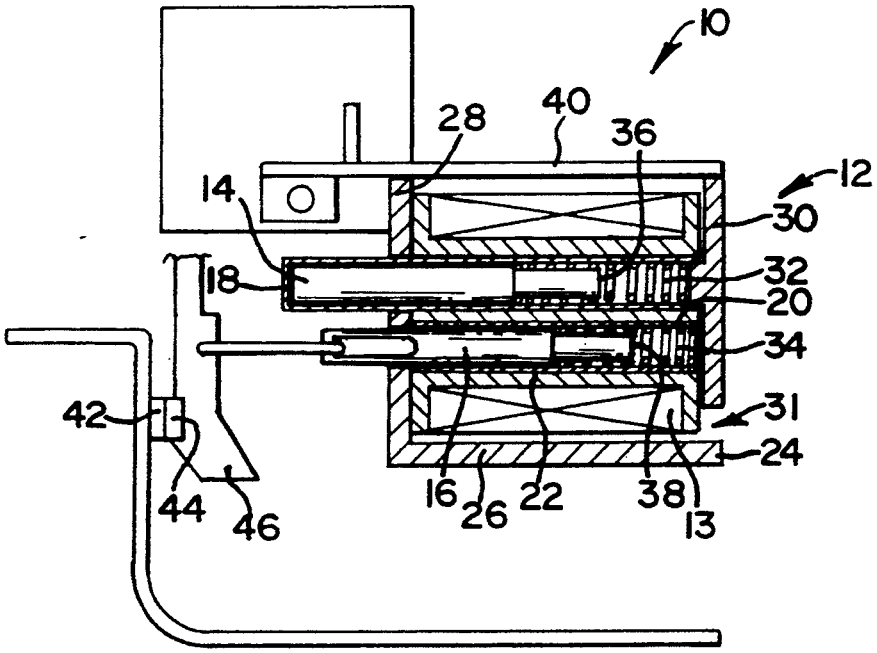
FIG. 4 is a further schematic sectioned view of the circuit breaker indicating how it responds to a high overload current.
Figure 5:
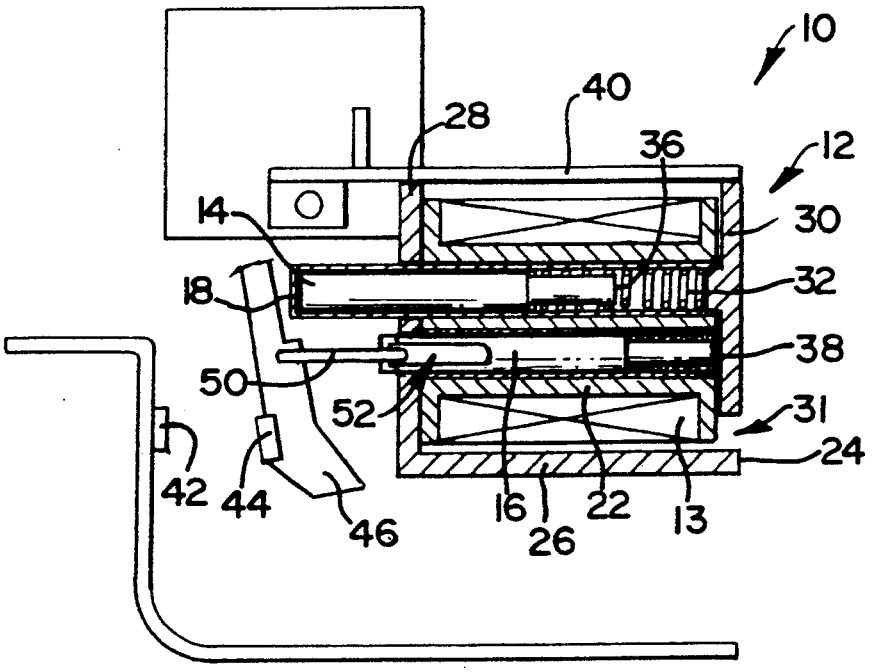
FIG. 5 is a still further schematic sectioned view of the circuit breaker indicating further how it responds to a high overload current.

Referring now to FIGS. 4 and 5 the manner in which the circuit breaker 10 responds to a high overload current is illustrated.

With an overload current that is high enough, the force acting on the second plunger 16 will be sufficient to displace it into contact with the pole piece 30. It will be appreciated that, although the force acting on the first plunger 14 will, initially, be greater than that acting on the second plunger 16, because of the damping effect of the liquid in the canister 18 the second plunger 16 will move closer to the pole piece 30 faster than the first plunger 14. When this occurs, because the flux is inversely proportional to the gap, the flux through the second plunger 16 will become greater than that through the first plunger 14 so that the force on the second plunger 16 will be greater than that on the first plunger 14.

Further, because the overload current is so high, the armature 40 will be displaced into contact with the post 28 and the pole piece 30 before the second plunger 16 comes into contact with the pole piece 30 (as shown in FIG. 4). Thus, the tripping mechanism is operated substantially instantaneously.

It will be appreciated that when the carrier 46 is in its closed position, the second plunger 16 is being accelerated towards the pole piece 30. The slot 52 and link 50 are so designed that before the second plunger 16 reaches the end of its travel, the link 50 reaches the end of the slot 52 so that further movement of the second plunger 16 towards the pole piece 30 causes the carrier 46 to be moved rapidly away from the fixed contact 42 (as shown in FIG. 4). When the second plunger 16 reaches the pole piece 30, the carrier 46 is then free to move fully towards its open position, with the link 50 then moving in the slot 52.

The high opening speed of the moving contact carrier 46 when there is a large overload current, introduces a high resistance to the electric circuit limiting the let-through current and the clearing time of the circuit breaker 10.

It will be appreciated by those skilled in the art that the characteristics of the circuit breaker 10 can be varied by varying the strength of the springs 32 and 34 and the air gaps between the plungers 14 and 16 and the pole piece 30.

Hence, it is an advantage of the invention, that the following can be achieved:

accurate trip point and time delay typical of a hydraulic-magnetic circuit breaker;

positive, accurate and easily pre-settable instantaneous tripping which is independent of the time delay of the damped first plunger;

effective acceleration of the moving contact carrier on short circuit, which provides proper current limiting; and substantial minimization of the possibility of contact welding during overloads.

I claim:

1. An electro-magnetically operable device for a circuit breaker, the device including a coil which defines a cavity;

a first plunger arranged in the cavity, the first plunger being displaceable within the cavity in a damped manner between a first, normal position and a second position;

a first urging means for urging the first plunger from its second position towards its first position;

a second plunger arranged in the cavity, adjacent the first plunger, the second plunger being displaceable within the cavity between a first, normal position and a second position;

a second urging means for urging the second plunger from its second position towards its first position;

a magnetic path defining means arranged about at least a part of the coil, the magnetic path defining means including a pole piece, the pole piece and the plungers being arranged such that a gap between the first plunger, when in its normal position, and the pole piece is less than a gap between the second plunger, when in its normal position, and the pole piece, with the second position of each plunger being closer to the pole piece than the first, normal position of each plunger; and an end of the second plunger, remote from the pole piece, carrying a link mechanically linking the second plunger to a moving contact carrier of the circuit breaker, said link being a lost-motion link such that the moving contact carrier can move independently of said second plunger, and said second plunger can, to a predetermined extent, move independently of the moving contact carrier.

2. A device according to claim 1 wherein the first plunger is houses in a sealed canister which contains a liquid to damp movement of the first plunger.

3. A device according to claim 1, wherein the first and second urging means are helical springs which are under compression, each spring being arranged intermediate its associated plunger and the pole piece.

4. A device according to claim 1 wherein the coil has a round or oval shape.

5. A device according to claim 1 wherein, in addition to the pole piece, the magnetic path defining means includes a stator frame arranged about the coil and an armature pivotally arranged relative to the stator frame, the armature being connectable to a tripping mechanism of the circuit breaker.

6. A device according to claim 5, wherein an air gap is defined between the stator frame and the pole piece.

7. A device according to claim 6, wherein the second plunger is located on that side of the cavity on which the air gap between the pole piece and the stator frame is located.

8. A device according to claim 5, wherein the stator frame defines two openings, one for the first plunger and one for the second plunger, the plungers projecting through said openings.

9. A circuit breaker which includes an electromagnetically operable device as claimed in claim 1.

10. A device according to claim 1, wherein said lost motion link comprises a link member connected to said moving contact carrier, and a slot in said second plunger receiving an end of said link member, said end of said link member being located in an intermediate position in said slot when the second plunger is in its normal position and being at an end of said slot when the second plunger moves towards said second position.

11. A device according to claim 10, wherein said second plunger approaches said pole piece to reach a closed position under conditions of large overload current, said link member being at said end of said slot before said second plunger is at said closed position.

12. A device according to claim 11, wherein said slot is located axially in said second plunger.

13. A device according to claim 12, wherein said armature is closer to said first plunger than to said second plunger.

* * * * *